United States Patent [19]

Hornsby

[11] 4,324,009

[45] Apr. 13, 1982

[54] SWIMMING POOL AND WATER SUPPLY SYSTEM

[76] Inventor: Roger L. Hornsby, Box H, Coolville, Ohio 45723

[21] Appl. No.: 145,608

[22] Filed: May 1, 1980

[51] Int. Cl.[3] ..... E04H 3/18

[52] U.S. Cl. ..... 4/492; 4/507; 4/509; 4/543; 52/169.7; 52/220

[58] Field of Search ..... 4/488, 490, 492, 494, 4/506-509, 513, 541-544, 538, 546, 567-569, 615; 52/220, 221, 169.7, 367, 677, 742, 707, 710; 138/105, 106; 128/66, 369; 137/362, 356

[56] References Cited

U.S. PATENT DOCUMENTS

| | | | |
|---|---|---|---|
| 2,469,963 | 5/1949 | Grosjean et al. | 52/220 X |
| 2,867,041 | 1/1959 | McMillan | 52/367 X |
| 2,978,840 | 4/1961 | Tatasch | 52/220 X |
| 3,157,597 | 11/1964 | Burba | 4/507 X |
| 3,251,071 | 5/1966 | Wood | 4/543 |
| 3,417,528 | 12/1968 | Hallock | 52/367 |
| 3,465,654 | 9/1969 | Fox | 52/220 X |
| 3,724,148 | 4/1973 | Bregenzer | 52/221 |
| 3,939,504 | 2/1976 | Linecker | 4/509 |
| 4,051,562 | 10/1977 | Jakowicki | 4/494 |
| 4,170,044 | 10/1979 | Steimle | 4/488 |

FOREIGN PATENT DOCUMENTS

| | | | |
|---|---|---|---|
| 2448630 | 4/1976 | Fed. Rep. of Germany | 4/507 |

*Primary Examiner*—Stuart S. Levy

[57] ABSTRACT

An improved swimming pool and water supply system characterized by a novel conduit or duct construction and arrangement which provides more efficient distribution of freshly filtered water throughout the pool. The duct means is also removably mounted in the bottom wall of the pool to provide ease of access for maintenance and repair.

2 Claims, 6 Drawing Figures

*PRIOR ART*

SWIMMING POOL AND WATER SUPPLY SYSTEM

BACKGROUND

Commercial swimming pools have for many years employed a water supply system where treated and sometimes heated water is recirculated through appropriate filter apparatus and then pumped back into the pool. The common feature of these prior pools consisted of a side wall gutter system wherein a duct or pipe embedded in the side wall functioned as the inlet source of freshly filtered water to the pool with the overflow water from the pool being returned to the filters via the side wall gutters.

One of the major problems with this construction is the inefficient distribution and circulation of fresh water throughout the pool and the resulting formation of a relatively stagnant area near the center of the pool area.

A further problem with this prior art construction is the difficulty and expense incident to repair of a break in the inlet piping or duct work. Since the outlet conduits are embedded within the side walls and the main feed pipe is disposed around the entire periphery of the pool under the patio, the walls and/or patio area would have to be broken out and replaced to repair any leak which may occur. Further, prior to the discovery of a leak or breakage, water would sometimes seep behind the side walls or under the bottom wall of the pool to cause further damage and require greater repair expense.

SUMMARY OF INVENTION

The present invention relates to a novel swimming pool construction and particularly to the water supply arrangement employed therein which provides a novel inlet water conduit or duct construction which is uniquely disposed in the bottom wall of the pool. Further, the inlet duct is removably mounted in a partially exposed manner which drammatically increases the ease of access for repair or replacement if necessary.

The location of the inlet conduit in the bottom wall along approximately the centerline of the pool in combination, with the conventional over flow gutter outlet in the upper portion of the side walls maximizes a desirable circulation and distribution pattern of freshly filtered water throughout the whole pool.

The construction of the inlet conduit in the bottom wall is also unique in that the exposed upper surface is provided with a plurality of removable cover plates which provide access to removable bolts fastening the conduit to the bottom wall. Therefore repair and maintenance is much less expensive as compared to prior art constructions.

This combination of features represents the solution to a long standing yet unsolved problem in the construction of such swimming pools in a relatively simple, direct manner. The method of installation permits this unique system to be employed at a competitive level with prior methods and means and yet provide for vast improvement of water circulation in the pool and ease of maintenance and repair.

OBJECTS

It is therefore an object of the present invention to provide an improved swimming pool construction and water supply system which substantially increases the efficiency of circulating filtered water throughout all areas of the pool.

It is another object of the present invention to provide a swimming pool of the type described wherein the inlet conduit means is removably mounted in the bottom wall of the pool for ease of access for repair or maintenance.

It is still another object of the present invention to provide a swimming pool of the type described wherein the inlet conduit includes a plurality of spaced access openings covered by a removable cover plate to provide access to the inner portions of the conduit for cleaning, repair and the like.

It is another object of the present invention to provide a swimming pool of the type described wherein the inlet conduit construction includes a support means which enhances the ease of proper installation during initial construction of the pool.

Further objects and advantages of the present invention will be apparent from the following description, reference being had to the accompanying drawings wherein a preferred form of embodiment of the invention is clearly shown.

IN THE DRAWING

DETAILED DESCRIPTION

Figure 1:
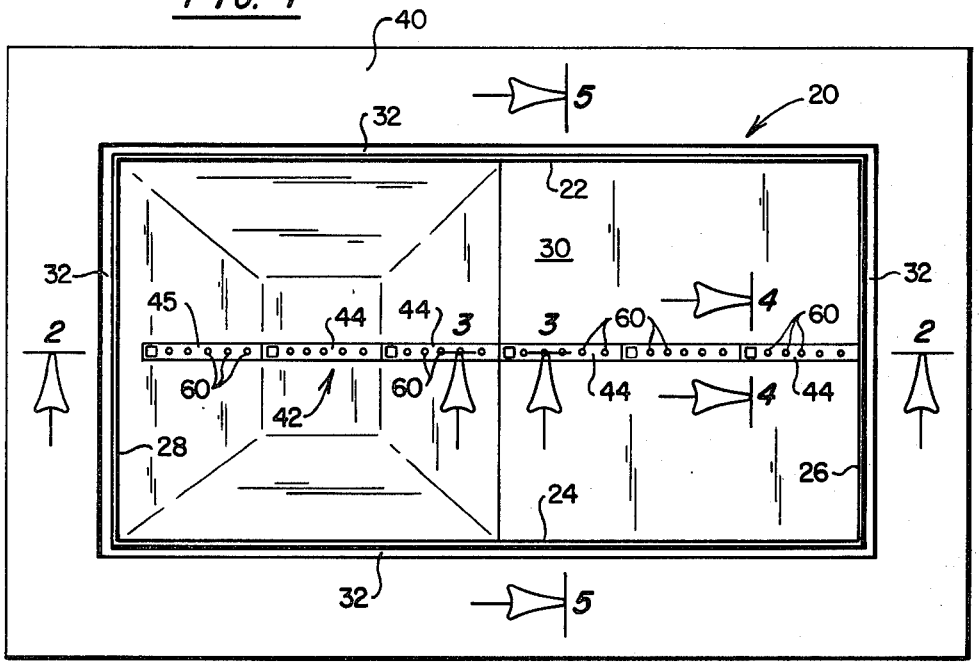
FIG. 1 is a top plan view of a typical commercial swimming pool constructed in accordance with the present invention.

A swimming pool of typical commercial dimensions constructed in accordance with the present invention is illustrated in FIG. 1 and includes the main body of the pool, indicated generally at 20, which is formed by side walls 22, 24, 26 and 28 and bottom wall 30. A pool drain may be employed in a conventional manner.

The side walls 22–28 may be formed in a conventional manner and include the side gutter or channel 32. Gutter channel 32 is provided with an inner lip 34 which is lower than the outer lip 36 and functions as an overflow water-level control for the pool.

The side portions of the pool are typically provided with a patio area 40 in a conventional manner.

Figure 2:
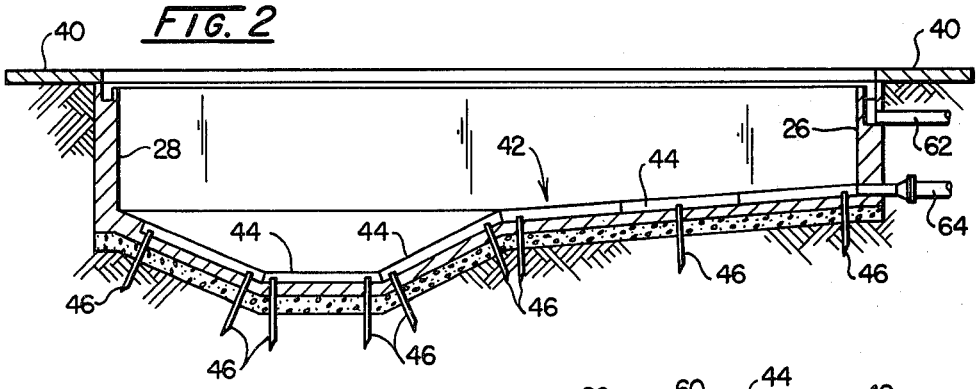
FIG. 2 is a side sectional view of the pool shown in FIG. 1, the section being taken along lines 2—2 in FIG. 1.
Figure 3:
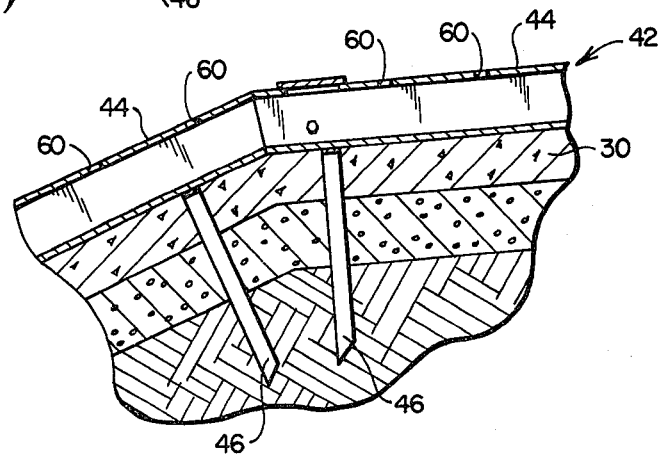
FIG. 3 is a partial side sectional view illustrating the inlet conduit construction of the pool shown in FIG. 1.
Figure 4:
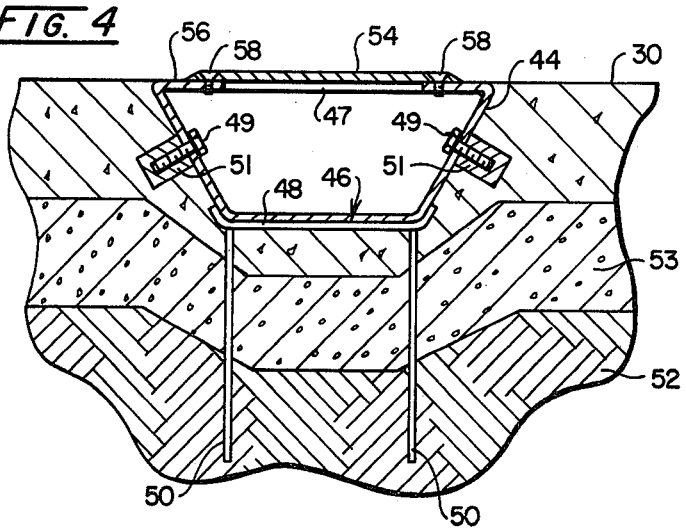
FIG. 4 is a partial end sectional view of the inlet conduit shown in FIG. 1, the section being taken along line 4—4 in FIG. 1.

Bottom wall 30, as best seen in FIGS. 2, 3 and 4 comprise conventional concrete poured over a gravel base. However, in accordance with the present invention, an inlet conduit, indicated generally at 42, is provided which communicates with a conventional filter and pump supply apparatus, not shown.

The inlet conduit system preferably comprises a plurality of sections 44. Each section 44 is supported upon a support means in the form of a stirrup 46.

Each stirrup 46 includes an upper surface 48 conforming generally to the configuration of the bottom portion of each section 44 and a pair of downwardly extending leg portions 50.

Stirrups 46 are initially placed and leveled at the desired position in the soil 52 prior to forming the gravel base 53 and pouring the concrete forming bottom wall 30. The contour of the ground, of course, has been previously prepared by conventional techniques to assume the desired configuration of the bottom wall and the size of the pool. Upon placement and appropriate leveling of stirrups 46, conduit sections 44 are placed upon the stirrups. Each section 44 is welded together to form the desired length dimension substantially along the centerline of the pool. The end section appropriately includes a closed end such as indicated at 45.

After sections 44 are in place at the desired location, anchor bolts 49 are positioned through holes provided in the side portions of each section 44 and fixed within a threaded metal casing 51.

This is easily accomplished since the top of each section 44 is provided with an access opening 47 covered by a removable cover plate 54 fastened to top wall 56 of the duct 44 by a plurality of bolts 58. The size of the access opening is sufficient to permit relatively easy manipulation of anchor bolts 49. The spacing of each opening and associated cover plate 54 is optionally determined by the chosen length of each duct section 44 and the location of anchor bolts 49 in the section to assure access to the bolts.

The concrete poured to form bottom wall 30 is predetermined such that the upper level is substantially flush with the upper surface of top wall 56 of duct sections 44. A conventional oil based coating is applied to the side walls of the duct sections 44 to inhibit any bonding of the duct sections to the concrete after pouring the same to prevent the sections from becoming firmly fixed within the concrete upon curing to enchance removability. However, threaded casings 51 are not prepared in such a manner since it is desired that casings 51 become fixed within the bottom wall upon curing of the concrete poured over them.

After the concrete is appropriately cured and casings 51 are fixed within the bottom wall, bolts 49 may be removed and rethreaded as needed. Cover plates 54 are then fastened over the openings and the installation is completed. It is preferred to apply a conventional sealant material along the interface between bottom wall 30 and the upper edge portions of sections 44 to prevent water from seeping under the duct sections 44.

Each duct section 44 is also provided with a plurality of small spaced openings such as 60 which function as outlets for the water delivered through the duct 42 to the pool. The size and spacing of outlet openings 60 are determined by the desired flow rate for a given pool and to a given extent the pattern of circulation within the pool.

Upon filling the pool with fresh water to the level determined by the side gutter outlet 32, the overflow is returned via the side gutters 32 to a main collection conduit 62 which is communicated to the filter and pump system. Freshly filtered and heated water if desired, is fed into the lower portion of the pool via supply conduit 64 connected to inlet conduit system 42.

Figure 5:
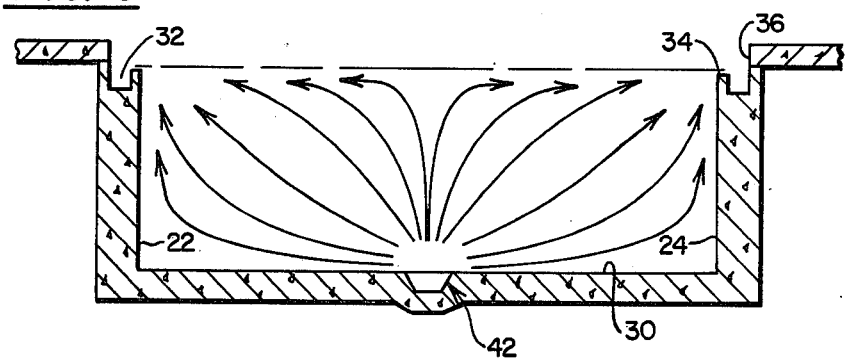
FIG. 5 is an end sectional view of the pool shown in FIG. 1 with the section being taken along lines 5—5 in FIG. 1.
Figure 6:
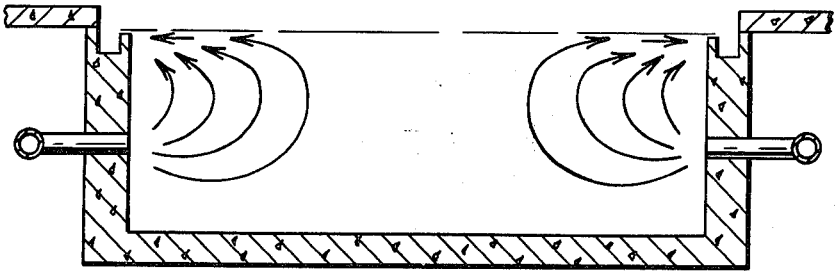
FIG. 6 PRIOR ART
FIG. 6 is an end sectional view illustrating a typical construction of a prior art pool.

The typical pattern of circulation in the pool is represented by the lines such as 66 in FIG. 5, wherein inlet water flows from a central location at the bottom of the pool outwardly and upwardly toward the side walls to more efficiently distribute the freshly filtered water throughout the pools, as compared to the pattern provided by the prior art systems illustrated in FIG. 6.

It should be pointed out that if a break or leak occurs in the conduit system 42, the sections 44 are readily accessible without the necessity of breaking through concrete walls or patio surfaces except at the one point of entry and exit. Further, any leak which may occur due to a weld break or the like, will merely flow into the pool and not behind or under the walls thereof to cause additional damage. If replacement of a section 44 is necessary, one may simply remove the cover plates 54 to have ready access to the anchor bolts 49 for removal of a damaged section 44. Upon repair, bolts 49 are threaded into casings 51 which are fixed in the concrete wall 30.

From the foregoing description, it should be readily apparent that the swimming pool constructed in accordance with the present invention represents a vast improvement over the prior art by providing a drammatically improved circulation pattern of freshly filtered, chlorinated water to eliminate stagnant areas or in the case of heated pools, cold spots. Further, maintenance and repair when necessary, may be accomplished with greater convenience and much less expense.

What is claimed is:

1. A swimming pool comprising, in combination, side walls and a bottom wall defining an enclosed pool area, said bottom wall including a longitudinally extending recessed portion formed along approximately the centerline of said bottom wall; an inlet water conduit means removably disposed in said recessed portion of said bottom wall and having an exposed upper surface provided with a plurality of longitudinally spaced outlet openings for communicating water to said pool area in a predetermined pattern; said inlet conduit means including a plurality of support means spaced from one another along the length of said conduit means, said support means including an upwardly facing stirrup portion disposed to receive a portion of said inlet conduit means and a pair of downwardly extending leg portions extending through said bottom wall of said pool portion and into the ground beneath said bottom wall to dispose said conduit means at a predetermined level within said bottom wall of said pool portion; and means for removably securing said conduit means to said support means and to the bottom wall of said pool portion and an outlet gutter channel formed along the upper portion of said side walls for receiving and transferring water above a predetermined level in said pool to a filter and pumping station disposed outside said pool area; and means communicating said inlet conduit means to said filter and pumping station to form a closed loop water circulation system for said pool.

2. The swimming pool defined in claim 1 wherein said conduit means includes a plurality of spaced access openings disposed in its upper surface and a plurality of cover plates, a respective one of said plates removably mounted over a respective one of said openings; and said means for securing said conduit means includes removable fastening means extended through a side wall of said duct means and into a threaded casing member fixed within said bottom wall of said pool portion and aligned with said spaced openings whereby said removable fastening means are accessible through said access openings upon removal of said cover plates.

* * * * *